US006872050B2

(12) United States Patent
Nenstiel

(10) Patent No.: US 6,872,050 B2
(45) Date of Patent: Mar. 29, 2005

(54) VARIABLE GEOMETRY DIFFUSER MECHANISM

(75) Inventor: Kurt Nenstiel, York, PA (US)

(73) Assignee: York International Corporation, York, PA (US)

( * ) Notice: Subject to any disclaimer, the term of this patent is extended or adjusted under 35 U.S.C. 154(b) by 79 days.

(21) Appl. No.: 10/313,364

(22) Filed: Dec. 6, 2002

(65) Prior Publication Data

US 2004/0109757 A1 Jun. 10, 2004

(51) Int. Cl.[7] ..... F04B 25/02
(52) U.S. Cl. ..... 415/151; 415/126
(58) Field of Search ..... 415/151, 150, 415/148, 126–7, 211.2, 146–8, 149.1, 170.1, 174.1

(56) References Cited

U.S. PATENT DOCUMENTS

| | | | | |
|---|---|---|---|---|
| 3,032,259 | A | | 5/1962 | Jassniker |
| 3,251,539 | A | | 5/1966 | Wolfe |
| 3,289,919 | A | | 12/1966 | Wood |
| 3,478,955 | A | | 11/1969 | Kunderman |
| 3,904,312 | A | | 9/1975 | Exley |
| 3,941,498 | A | | 3/1976 | Duckworth et al. |
| 3,992,128 | A | | 11/1976 | Lunsford et al. |
| 4,403,914 | A | | 9/1983 | Rogo et al. |
| RE31,835 | E | | 2/1985 | Rannenberg |
| 4,503,684 | A | | 3/1985 | Mount et al. |
| 4,579,509 | A | | 4/1986 | Jacobi |
| 4,611,969 | A | | 9/1986 | Zinsmeyer |
| 4,616,483 | A | | 10/1986 | Leonard |
| 4,718,819 | A | | 1/1988 | Rogo et al. |
| 4,780,049 | A | | 10/1988 | Palmer et al. |
| 4,844,690 | A | * | 7/1989 | DeLaurier et al. ..... 415/148 |
| 5,116,197 | A | | 5/1992 | Snell |
| 5,146,764 | A | | 9/1992 | Bauman et al. |
| 5,207,559 | A | * | 5/1993 | Clevenger et al. ..... 415/166 |
| 6,036,432 | A | * | 3/2000 | Sishtla et al. ..... 415/26 |
| 6,139,262 | A | | 10/2000 | Ravidranath |
| 6,158,956 | A | | 12/2000 | Arnold |
| 6,361,432 | B1 | | 3/2002 | Walker |
| 2002/0014088 | A1 | | 2/2002 | Seki et al. |

* cited by examiner

*Primary Examiner*—Edward K. Look
*Assistant Examiner*—J. M. McAleenan
(74) *Attorney, Agent, or Firm*—Carmen Santa Maria; Brian T. Sattizahn; McNees Wallace & Nurick LLC

(57) ABSTRACT

A system for preventing stall in a centrifugal compressor. The compressor includes an impeller rotatably mounted in a housing and a nozzle base plate fixed to the housing adjacent the impeller. The nozzle base plate cooperates with the housing to define a diffuser gap. The base plate includes a plurality of mechanism support blocks positioned on the backside of the nozzle base plate. A drive ring, mounted to the support blocks, is rotationally moveable with respect to the support blocks and the nozzle base plate between a first position and a second position. Connected to the drive ring is a diffuser ring that moves in response to movement of the drive ring. Diffuser ring moves between a retracted position that is not within the diffuser gap and an extended position extending into the diffuser gap to constrict the gap opening and reduce the flow of fluid through the diffuser gap. The diffuser ring can be positioned at any location between the retracted and extended position to control the amount of fluid flowing through the diffuser gap.

37 Claims, 11 Drawing Sheets

VARIABLE GEOMETRY DIFFUSER MECHANISM

FIELD OF THE INVENTION

The present invention is directed to centrifugal compressors, and more particularly to a system for controlling the flow in the diffuser of a variable capacity turbo compressor.

BACKGROUND OF THE INVENTION

Centrifugal compressors are useful in a variety of devices that require a fluid to be compressed. The devices include, for example, turbines, pumps, and chillers. The compressors operate by passing the fluid over a rotating impeller. The impeller works on the fluid to increase the pressure of the fluid. Because the operation of the impeller creates an adverse pressure gradient in the flow, many compressor designs include a diffuser positioned at the impeller exit to stabilize the fluid flow.

It is often desirable to vary the amount of fluid flowing through the compressor or the pressure differential created by the compressor. However, when the flow of fluid through the compressor is decreased, and the same pressure differential is maintained across the impeller, the fluid flow through the compressor often becomes unsteady. Some of the fluid stalls within the compressor and pockets of stalled fluid start to rotate with the impeller. These stalled pockets of fluid are problematic in that they create noise, cause vibration, and reduce the efficiency of the compressor. This condition is known as rotating stall or incipient surge. If the fluid flow is further decreased, the fluid flow will become even more unstable, in many cases causing a complete reversal of fluid flow. This phenomenon, known as surge, is characterized by fluid alternately surging backward and forward through the compressor. In addition to creating noise, causing vibration, and lowering compressor efficiency, fluid surge also creates pressure spikes and can damage the compressor.

A solution to the problems created by stall and surge is to vary the geometry of the diffuser at the exit of the impeller. When operating at a low fluid flow rate, the geometry of the diffuser can be narrowed to decrease the area at the impeller exit. The decreased area will prevent the fluid stalling and ultimately surging back through the impeller. When the fluid flow rate is increased, the geometry of the diffuser can be widened to provide a larger area for the additional flow. The variable geometry diffuser can also be adjusted when the pressure differential created by the compressor is changed. When the pressure differential is increased, the geometry of the diffuser can be narrowed to decrease the area at the impeller exit to prevent fluid stall and surge. Similarly, when the pressure differential is decreased, the geometry of the diffuser can be widened to provide a larger area at the impeller exit.

Several devices for varying the geometry of the diffuser are disclosed in the prior art. For example, U.S. Pat. No. 5,116,197 to Snell discloses a variable geometry diffuser for a variable capacity compressor. This device, and others like it, include a moveable drive ring that may be selectively adjusted to vary the geometry of the diffuser at the impeller exit. The ring is positioned adjacent to one wall of the diffuser and can be moved out into the flow of fluid to decrease the area of the diffuser to account for a lower fluid flow or an increased pressure differential.

When the ring is positioned in the fluid flow, the known devices create an opening between the ring and the wall into which fluid exiting the impeller will flow. When attempting to move the ring out of the fluid flow, the fluid must be cleared from between the ring and wall. Displacing this fluid so the ring can be moved requires a significant amount of force, since the fluid acts to oppose the motion of the wall.

Devices such as set forth in Snell are expensive, as the drive ring pilots on a nozzle base plate. The nozzle base plate includes precision-machined tracks machined into its cylindrical outer surface. The drive ring includes corresponding spherical pockets on its inside diameter. Balls are mounted between the nozzle base plate and the drive ring, sliding in the tracks and pockets, the arrangement converting the rotational movement of the drive ring into axial movement while preventing the drive ring and the nozzle base plate from becoming disconnected. This assembly, however, is expensive to fabricate, as close tolerances must be maintained between the inner diameter of the drive ring and the outer diameter of the nozzle base plate. In addition, the spherical pockets on the drive ring must be matched to the tracks on the nozzle base plate. Furthermore, wear will ultimately result in the replacement of both the drive ring and the nozzle base plate.

Another approach is set forth in Publication US 2002/0014088A1 to Seki et al. In this approach, the ring which is positioned in the fluid flow is supported by the casing. Three protrusions from the casing are fitted into grooves on the outer peripheral face of the diffuser ring. A bearing may be used with each protrusion to suppress rubbing contact between the casing and the diffuser ring. The diffuser ring is connected to a shaft. Rotation of the shaft causes the diffuser ring via a bracket to rotate in the circumferential direction. The circumferential movement causes the diffuser ring to move axially as the protrusions guide the axial movement of the diffuser ring along the grooves. While effective, the approach is expensive, as the protrusions must be accurately placed in the casing. The threaded shaft and motor for shaft rotation also add expense to this assembly.

In light of the foregoing, there is a need for a variable geometry diffuser for a variable capacity compressor that may be easily opened and closed during the operation of the compressor. The variable geometry diffuser should be inexpensive to manufacture, easy to assemble, simple to repair or replace and provide positive engagement for accurate position determination in response to signals or commands from the controller.

SUMMARY OF THE INVENTION

The present invention provides a system for a variable capacity centrifugal compressor for compressing a fluid. The compressor includes an impeller rotatably mounted in a housing. The system includes a nozzle base plate fixed to the housing adjacent the impeller. The nozzle base plate has an elongated surface that cooperates with an opposed interior surface on the housing to define a diffuser gap or outlet flow path. The base plate includes a plurality of mechanism support blocks mounted to the backside of the nozzle base plate. A drive ring is mounted to the support blocks and is rotationally moveable with respect to the support blocks and the nozzle base plate. The drive ring is selectively moveable between a first position and a second position. Connected to the drive ring is a diffuser ring that moves in response to movement of the drive ring. Diffuser ring moves between a retracted position corresponding to a first position of the drive ring and an extended position corresponding to a second position of the drive ring. In the open or retracted position, the diffuser ring is retracted into a groove so that the face diffuser ring is flush with the face of the nozzle base plate, and the diffuser gap is unobstructed to permit the maximum fluid flow therethrough. In the closed or extended position, the diffuser ring extends outward into the diffuser gap to constrict the gap opening and reduce the flow of fluid through the diffuser gap. The diffuser ring can be positioned at any location between its retracted and extended positions to control the amount of fluid flowing through the diffuser gap.

The drive ring includes a plurality of cam tracks fabricated into its outer periphery surface, each cam track corresponding in position to a mechanism support block. Assembled to the mechanism support block is a drive pin having a cam follower that is assembled into the cam track. An actuating rod is attached to the drive ring. The actuating rod can move in an axial direction, thereby causing the drive ring to rotate. As the drive ring rotates, the cam followers in the cam tracks cause the drive pins to move in an axial direction. The diffuser ring, connected to the drive ring as a result of being attached to the opposite end of the drive pins, moves with motion of drive pins between its retracted position corresponding to the first position of the drive ring to an extended position corresponding to a second portion of the drive ring. Drive ring, and hence diffuser ring, may be stopped at any intermediate position between a first position (fully retracted) and a second position (fully extended).

An advantage of the present invention is that the rotational motion of the drive ring can be converted to axial motion by the mechanism of the present invention. This axial motion can be achieved rapidly and effectively in response to appropriate signals from the controller by an axially movable actuating rod.

Another advantage of the present invention is that the diffuser ring of the present invention can be placed anywhere within the compressor as long as it can be extended into and retracted from the diffuser gap. Because the support blocks carry the load of the diffuser ring, the diffuser ring can assume any position, provided of course, that it can be extended or retracted into the diffuser gap. Thus, unlike prior art devices, the diffuser ring may be placed further downstream in the diffuser, if desired. Since the diffuser ring does not have to be carefully match machined to mate with structures such as the inner diameter of the nozzle base plate and is not supported on the casing, and requires only the extension or retraction of the diffuser ring into the diffuser gap to control the flow of fluid in the diffuser gap, the diffuser ring tolerancing can be loosened thereby reducing its costs.

Still a further advantage of the present invention is that not only is the diffuser ring less expensive to manufacture and easy to replace, but also the mechanisms for controlling the movement of the diffuser ring are easier and cheaper to replace, as the parts wear.

Yet another advantage of the present invention is that the mechanism for controlling the diffuser ring includes allowances for over travel, so that the diffuser ring can be quickly moved into the completely extended or retracted position without concerns about excessive wear at these end points.

Another advantage of the present invention is that the over travel allows the control logic not to be affected by the actual positioning of the diffuser ring. The control logic instead can react solely to noise associated with surge, closing fully the diffuser ring until the condition has abated.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
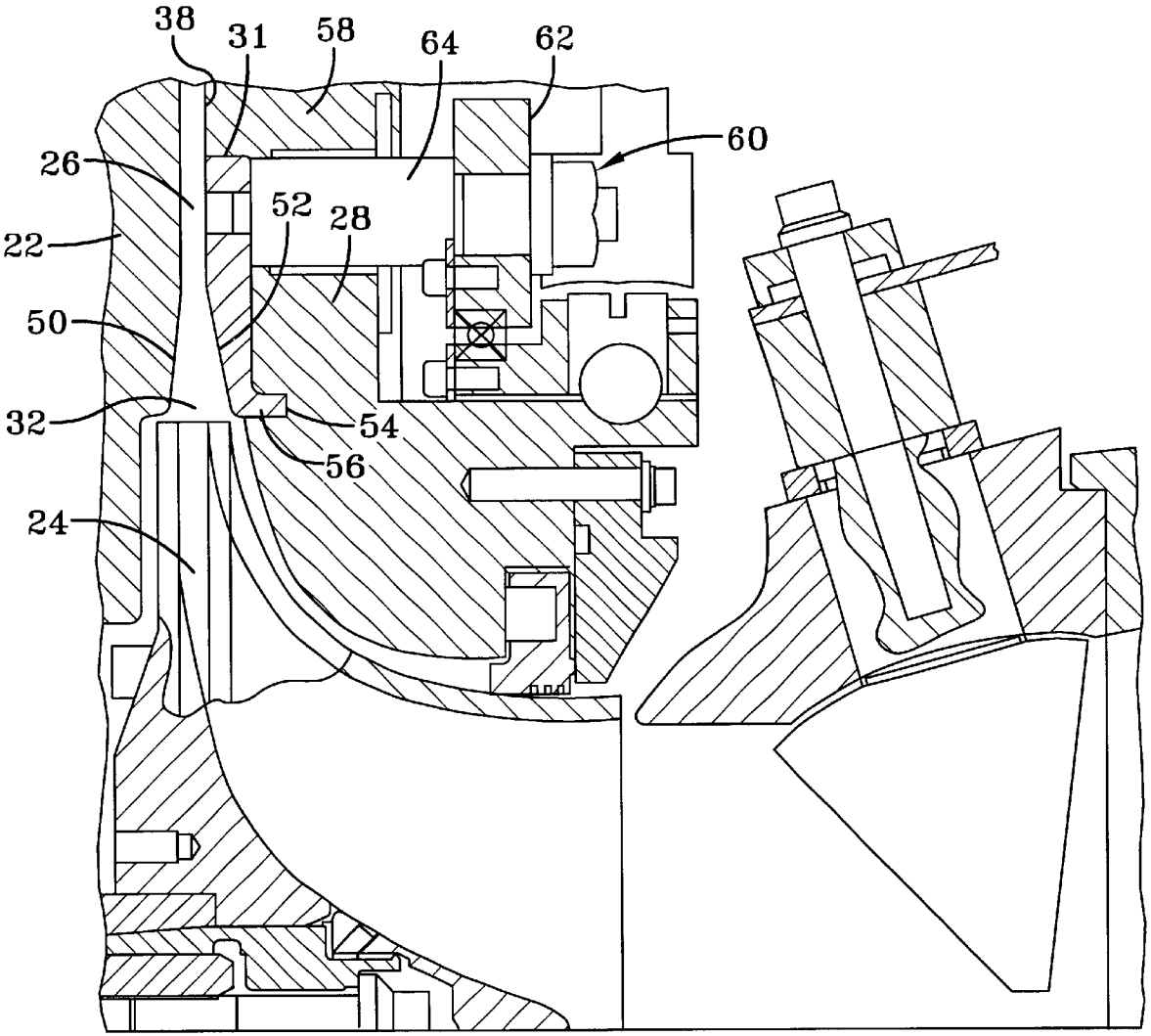
FIG-1 PRIOR ART
FIG. 1 is a cross section view of a prior art centrifugal compressor having a variable geometry diffuser.

The present invention is a variable geometry diffuser mechanism for a centrifugal compressor. FIG. 1 depicts a prior art variable capacity centrifugal compressor having a different diffuser configuration. The system of the prior art utilizes a movable wall as an annular ring positioned adjacent to the exit of the impeller. The wall is movable into the diffuser space, as is typical, to control the flow of fluid through the diffuser. The annular ring is disposed on the base plate. The ring is connected to an intricate support structure for moving the wall that includes an annular push ring and pins connected to the wall. A drive ring is mounted on the base plate via a ball bearing arrangement. The drive ring pushes annular push ring which in turn moves the wall. The ball bearing arrangement rides in a race in the drive ring and in inclined races in the base plate. The rotational motion of the drive ring by any suitable mechanism thus results in an axial movement of the moveable wall into and out of the diffuser space. A more detailed description of the assembly and operation of this arrangement can be found in U.S. Pat. No. 6,139,262 issued Oct. 31, 2000, assigned to the assignee of the present invention and incorporated herein by reference.

Figure 2:
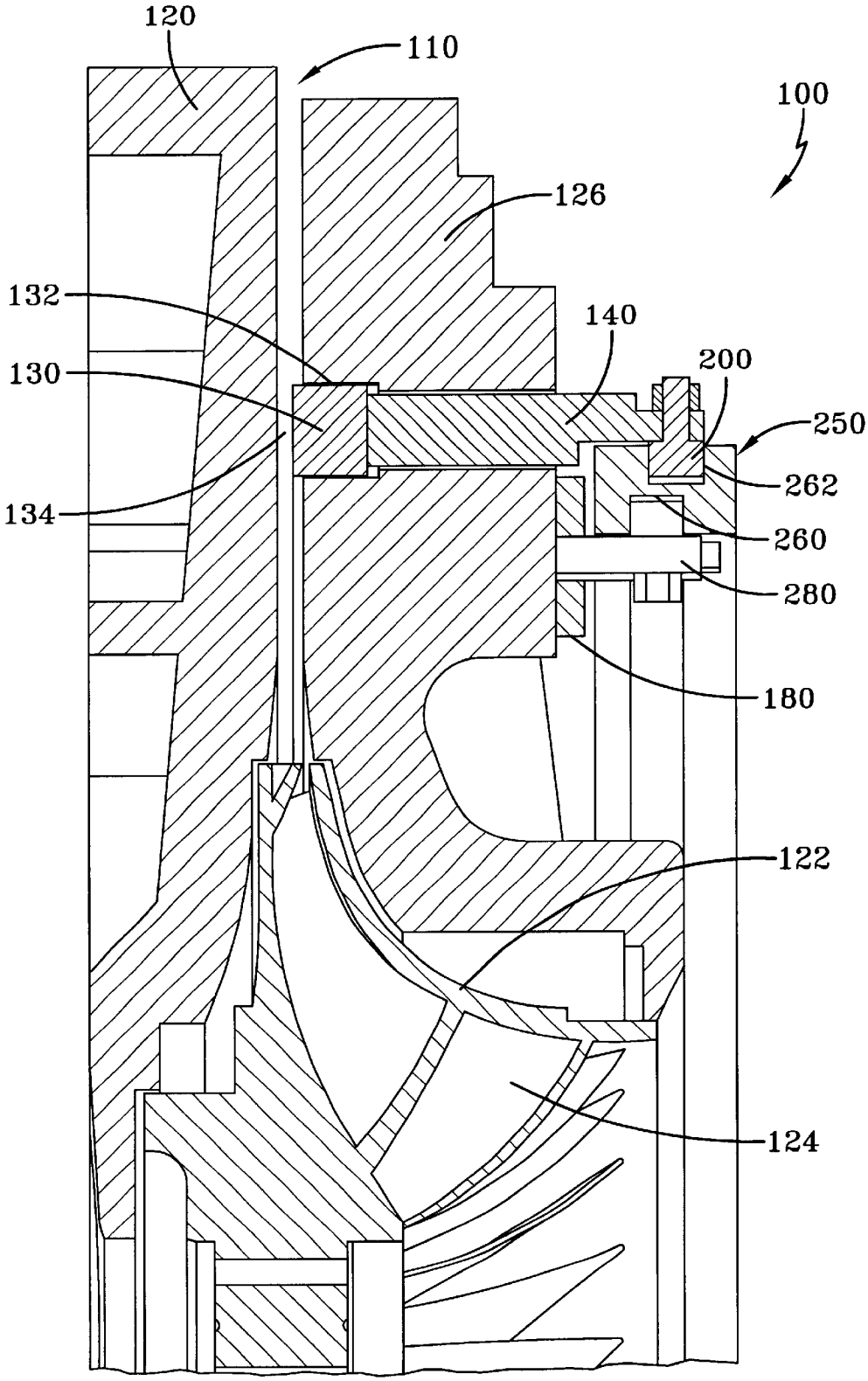
FIG. 2 is a cross section view of the variable geometry diffuser of the present invention in a centrifugal compressor.

FIG. 2 is a cross section view of a centrifugal compressor 100 having the variable geometry diffuser 110 of the present invention. As illustrated in FIG. 2, compressor 100 includes a housing or diffuser plate 120, an impeller 124, and a nozzle base plate 126. A diffuser ring 130, part of the variable geometry diffuser 110 of the present invention, is assembled into a groove 132 machined into nozzle base plate 126. Diffuser ring 130 is movable away from groove 132 and into diffuser gap 134 that separates diffuser plate 120 and nozzle base plate 126. In the completely retracted position, diffuser ring 130 is nested in groove 132 in nozzle base plate 126 and diffuser gap 134 is in a condition of maximum flow. In the completely extended position, diffuser ring 130 extends substantially across diffuser gap 134, essentially closing diffuser gap 134. The diffuser ring 130 can be moved to any position intermediate the completely retracted position and the completely extended position.

The directional flow of fluid into the compressor is controlled by the inlet guide vanes, shown as item 26 in FIG. 1, which can be rotated about their axis in a limited fashion to control the direction and to adjust the flow of fluid through the compressor. The inlet guide vanes 26 are not shown in any of the other Figures, as their location will not vary significantly from one centrifugal compressor to another, being positioned upstream of the impellers, and their location is not critical to the operation of this invention. The rotation of the vanes 26 through the range of rotation changes the capacity of the compressor. The vanes 26 typically include a means for determining their relative position, such as a position sensor, so that the amount of fluid flow through the compressor can be determined and the flow can be adjusted as desired by the actuator.

After passing the inlet vanes 26, the fluid typically in the form of a refrigerant or a refrigerant mixed with a lubricant mist flows over impeller 24 (FIG. 1) or 124 (FIG. 2). The rotation of the impeller 124 imparts work to the fluid, thereby increasing its pressure. As is well-known in the art, a fluid of higher pressure exits the impeller and passes through diffuser gap 134 as it ultimately is directed to the compressor exit.

Figure 3:
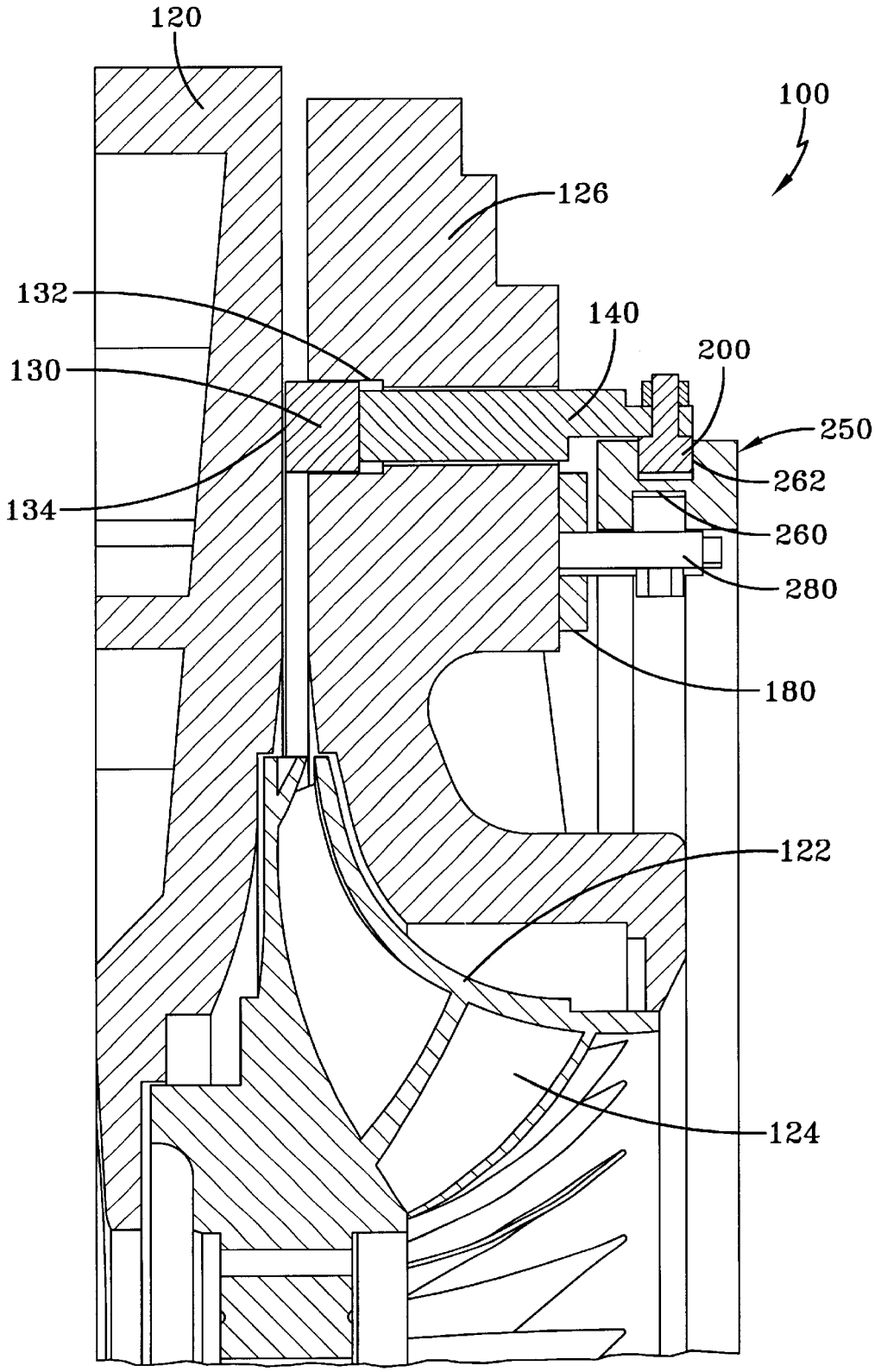
FIG. 3 is a cross section view of the variable geometry diffuser of the present invention in a centrifugal compressor in which the diffuser ring of the present invention is in the extended or closed position.

As the compressor load decreases, the inlet guide vane 26 rotate to decrease the fluid flow exposed to impeller 124. However, as the same pressure is maintained across impeller 124, the fluid flow exiting the compressor can be come unsteady and may flow backwards to create the surge condition discussed above. In response to the lower flow, to prevent the surge condition, the diffuser gap 134 is reduced to decrease the area at the impeller exit and stabilize fluid flow. The diffuser gap 134 is controlled by moving diffuser ring 130 into the gap 134 to decrease its area, as shown in FIG. 3 or to increase the area by moving the diffuser ring 130 back into groove 132, shown in the maximum flow condition in FIG. 4.

The arrangement and operation of the variable geometry diffuser 110 of the present invention will now be described in detail with further reference to the drawings.

Figure 5:
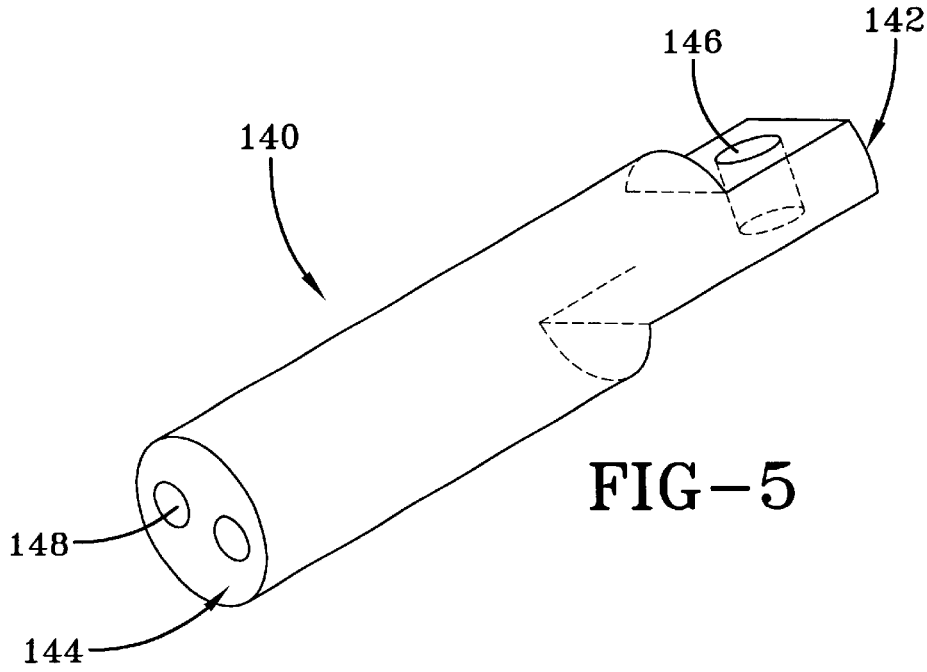
FIG. 5 is a perspective view of a drive pin of the present invention.

The variable geometry diffuser 110 of the present invention comprises diffuser ring 130. Diffuser ring 130 is attached to drive pin 140. Referring now to FIG. 5, drive pin 140 has a first end 142 and a second end 144 to mate with diffuser ring 130. At first end 142 of drive pin 140 is a cam follower aperture 146. At second end 144 of drive pin 140 is a means for attachment of drive pin 140 to diffuser ring 130. In the preferred embodiment, means for attachment is at least one aperture 148, which as shown, includes a pair of threaded apertures.

Figure 6:
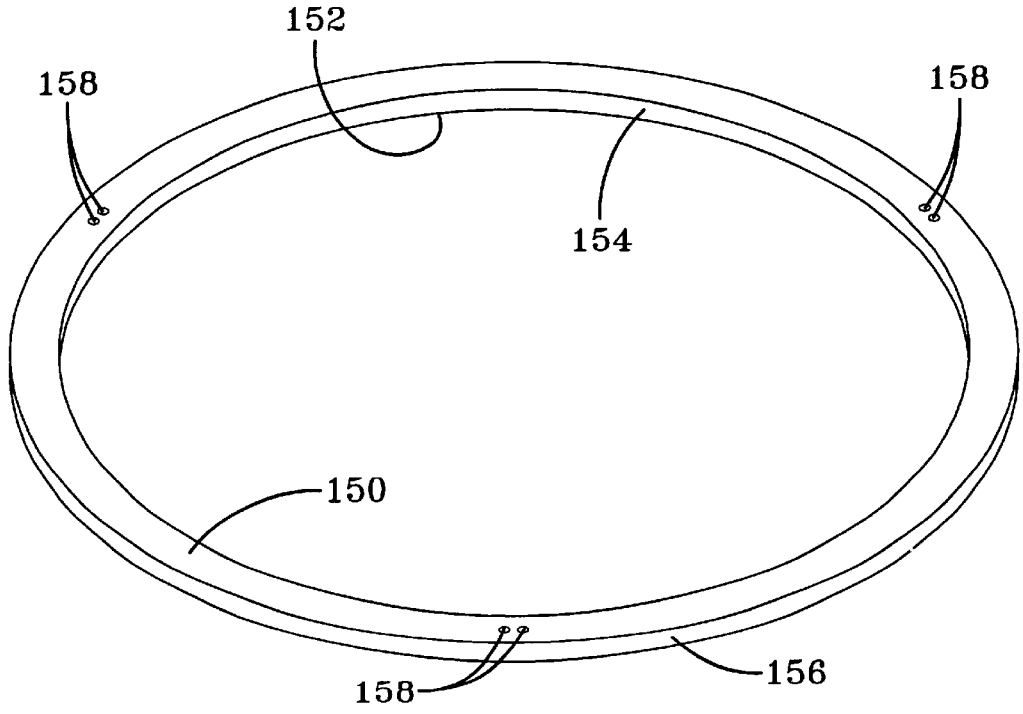
FIG. 6 is a perspective view from above of a diffuser ring of the present invention.
Figure 7:
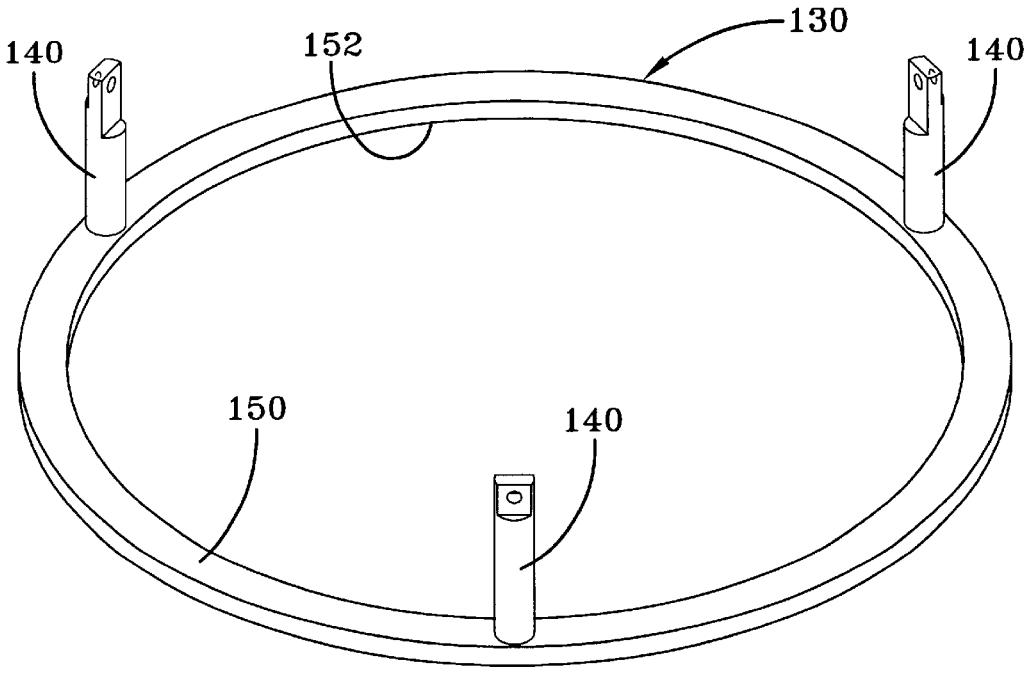
FIG. 7 is a perspective view of drive pins assembled to a diffuser ring of the present invention.

Diffuser ring 130, shown in FIG. 6, has a has a first face, 150, a second opposed face 152, an inner circumferential wall 154 extending between first face 150 and second face 152 and an outer circumferential wall 156 extending between first face 150 and second face 152, substantially concentric to inner circumferential wall 154. Diffuser ring 130 has a predetermined thickness, the thickness determined by the distance between inner circumferential wall 154 and outer circumferential wall 156, and a predetermined axial length, the axial length determined by the distance between first face 150 and opposed second face 152. A plurality of apertures 158 extend through the axial length of diffuser ring 130 and form part of the attachment means between the drive pin 140 and diffuser ring 130. As shown in the preferred embodiment, the plurality of apertures includes three pair of apertures 158. Each pair of apertures 158 is located on ring 130 to correspond to apertures 148 in drive pin. Second face 152 (not shown in FIG. 5) of diffuser ring 130 is assembled adjacent to face of drive pin 140. Second face 152 may optionally include counterbores opposite apertures 158 to accept drive pin 140, if desired. In FIG. 7, a plurality of drive pins 140 are shown assembled to diffuser ring 130. Threaded fasteners extending through apertures 158 into apertures 148 of drive pin 140 secure the drive pin 140 to diffuser ring. As shown, the means of attachment of the drive pin 140 to diffuser ring 130 includes threaded fasteners extending through apertures 158 into apertures 148. However, the means of attachment is not so limited, as any known means of mechanical fastening may be utilized. For example, drive pin second end 144 may be threaded and be threadably received by diffuser ring. Alternatively, pin 140 may be secured to ring 130 by, for example, tack welding. The means of securing the pin 140 to the diffuser ring 130 is not critical, as any means of securing these parts together is acceptable.

Figure 8:
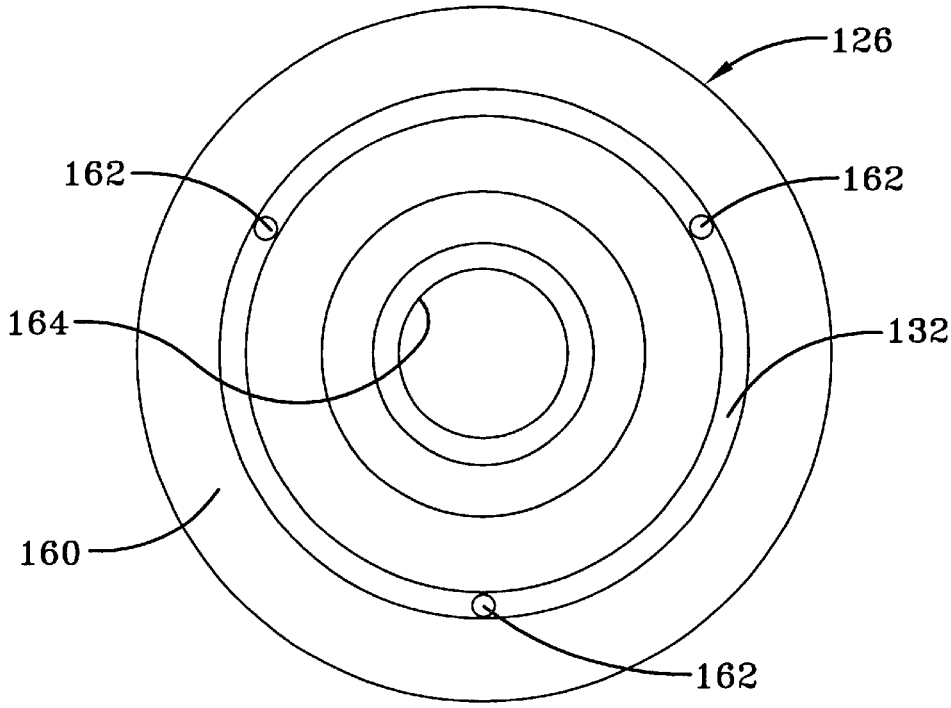
FIG. 8 is a perspective view of the front of the nozzle base plate.

FIG. 8 depicts a perspective view of the front side 160 of nozzle base plate 126. Groove 132 extends around the circumference of nozzle base plate 126. A plurality of apertures 162 penetrate nozzle base plate 126 in groove 132. These apertures accommodate drive pin 140, to which is attached diffuser ring 130. In the preferred embodiment as shown in FIG. 8, there are three apertures 162 located about 120° apart. Large central aperture 164 accepts the drive shaft (not shown) of compressor 100 to which is mounted impeller 124.

Figure 9:
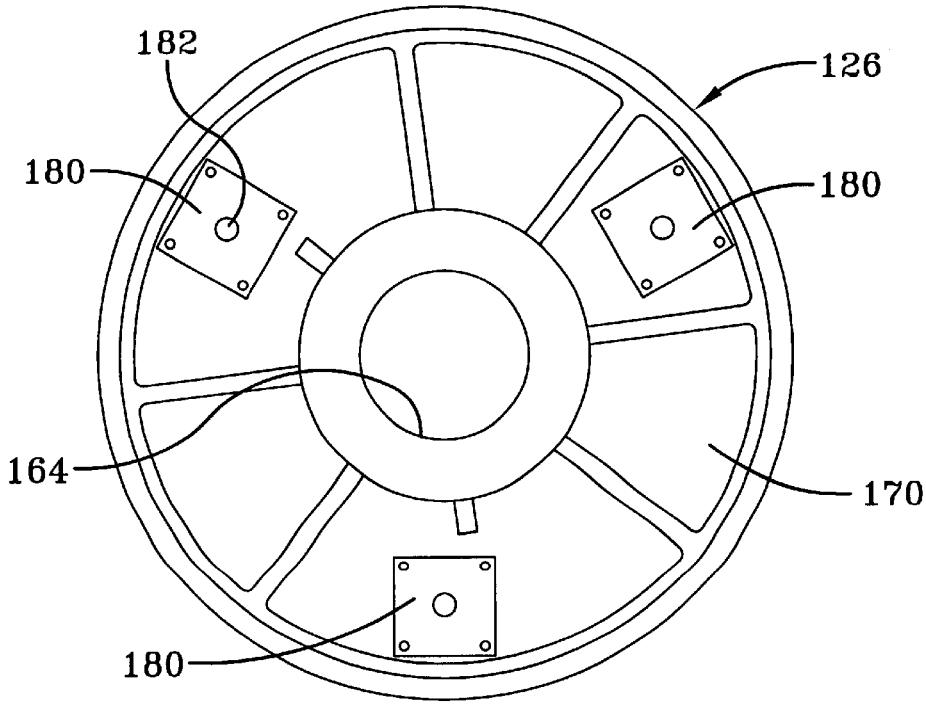
FIG. 9 is the rear of the nozzle base plate, showing support blocks assembled thereto.

FIG. 9 depicts the rear side 170 of nozzle base plate 126. Attached to the rear side 170 of nozzle base plate 126 are a plurality of support blocks 180. The support blocks 180 may be separate pieces assembled to base plate 170, which is most useful for retrofit applications. Alternatively, support blocks 180 may be an integral part of nozzle base plate 170. Most typically, these blocks may be configured into the cast base plate geometry. In the preferred embodiment, depicted in FIG. 9, there are three support blocks 180. Each support block includes a main aperture 182 that penetrate support blocks 180. Support blocks 180 are assembled to rear side 170 of base plate 126 so that each main aperture 182 through support block 180 is coaxial with each aperture 162 through nozzle base plate 126. These coaxial apertures 162, 182 each accept a drive pin 140, as will become more apparent.

Figure 10:
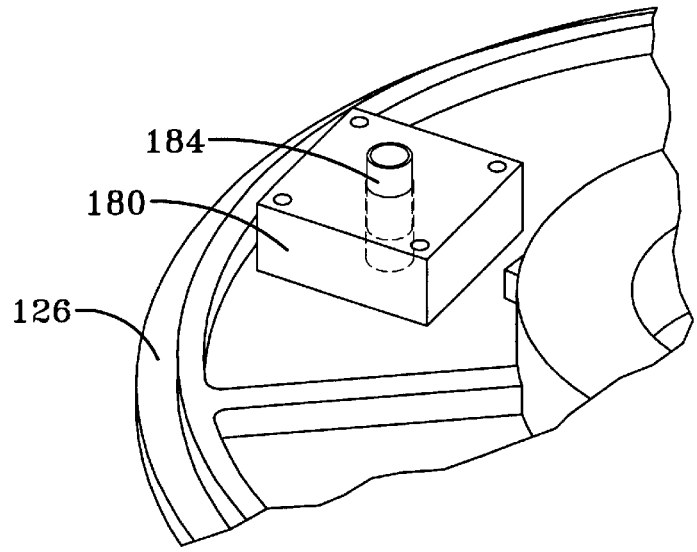
FIG. 10 is an enlarged view of FIG. 9 depicting a support block assembled to the nozzle base plate.

FIG. 10 is an enlarged perspective view of a support block 180 assembled to base plate 126. A bushing 184 is assembled into aperture 182. In a preferred embodiment, this bushing 184 is TEFLON®-coated and press fit into aperture 182. A drive pin 140 slides into bushing 184 as shown in FIG. 11, an enlarged view of support block 180 assembled to base plate 126 with drive pin 140 assembled therein.

Figure 11:
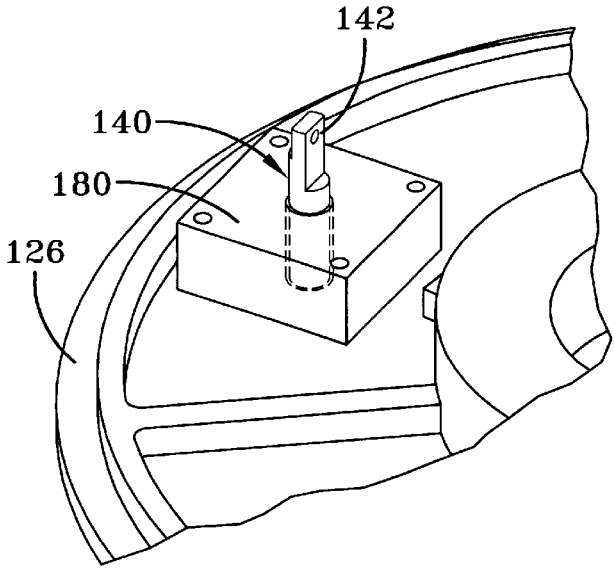
FIG. 11 is an enlarged view of FIG. 9 depicting a drive pin assembled to the support block on the nozzle base plate.
Figure 12:
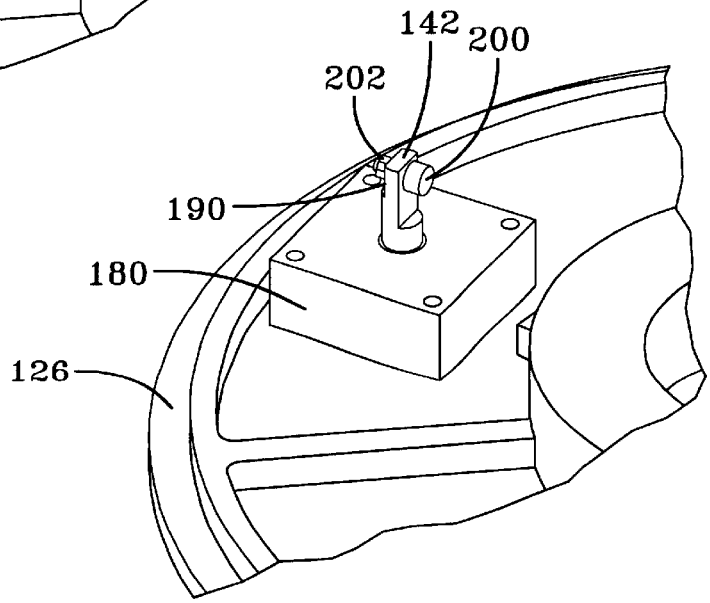
FIG. 12 is a side view of FIG. 9 depicting the pin with a cam follower assembled thereto.

Referring to FIG. 11 and FIG. 12, drive pin first end 142 extends above support block 182. As depicted in FIG. 12, drive pin first end 142 has flat surfaces 190 perpendicular to the axis of cam follower aperture 146. While any geometry may be utilized, this geometry permits ease of assembly of cam follower 200 to drive pin first end 142. Cam follower 200 is assembled through aperture 146 and secured to drive pin 126 with a nut 202. Any means, such as a lock pin arrangement, of securing cam follower 200 to drive pin 126 may be used, as long as cam follower 200 is free to rotate. Preferred means include those that can be readily assembled and disassembled.

Figure 13:
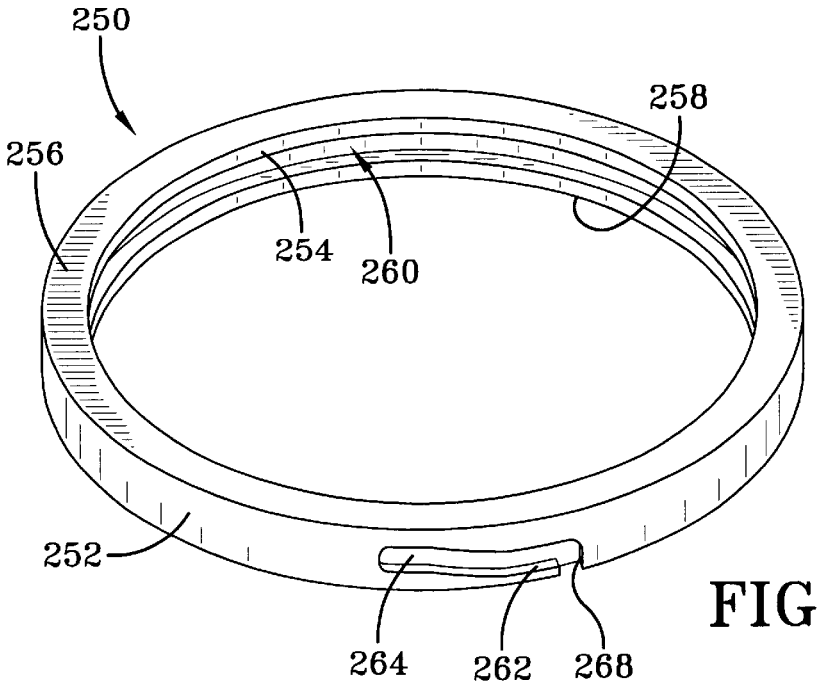
FIG. 13 is a perspective view of a drive ring of the present invention.

FIG. 13 is a perspective view of drive ring 250. Drive ring 250 includes an outer circumferential surface 252 and an inner circumferential surface 254, both extending between its top surface 256 and its bottom surface 258. The axial length of drive ring 250 is the axial distance between top surface 256 and bottom surface 258, the axis of the drive ring 250 being an imaginary line extending through and perpendicular to planes extending through the top and bottom surfaces 256, 258, generally the axis being located in the geometric center of drive ring 250. Located along inner circumferential surface 254 is an inner circumferential groove 260. Groove 260 is of preselected width to accept an axial bearing, as will be explained below. As shown in FIG. 13, inner circumferential groove 260 extends 360° around the inner circumferential surface 254 for ease of manufacturing. As will become apparent, groove 260 does not have a limitation of extending 360°. Located on outer circumferential surface 252 are a plurality of cam tracks 262, although only one is shown. These cam tracks 262 are grooves fabricated into the outer circumferential surface 252 at a preselected depth and at a preselected width to receive cam follower 200. Ideally, each cam track 262 should correspond to and mate with a support block 180. Thus, in the preferred embodiment as depicted in FIG. 9, which depicts three support blocks 160, drive ring 250 would have three corresponding cam tracks 262. Cam tracks 262 comprise the groove that extends along outer circumferential surface at a preselected angle to the axis of the drive ring between top surface 256 and bottom surface 258. At either end of cam track 262, the groove includes a circumferential portion 264 that is substantially parallel to the top surface 256 and bottom surface 258 to allow for overtravel. At the end of cam track groove proximate bottom surface 258, groove includes a portion 268 that extends to bottom surface 258 to provide access for assembly of cam follower 200 into groove. Although portion 268 is shown substantially parallel to the main axis of drive ring 250, any configuration that assists in assembly may be used. For example, portion 268 may also extend upward into top surface 256 from horizontal. Cam track 262 has two components, one of which is parallel to the axis of drive ring 250 and one that extends circumferentially about drive ring 250 in a direction radial to the axis of drive ring 250. The distance that cam track 262 extends parallel to the axis of drive ring 250 corresponds substantially to the width of diffuser gap 134. The angle of the cam shaft groove can be any preselected angle. As the angle becomes shallower, the more precise is the control of drive ring 250 and hence diffuser ring 130. However, there is a lower limit to this angle, which is dictated by the diameter of drive ring 250 and the number of cam followers in the outer diameter of drive ring 250. If the angle becomes too large, drive ring 250 can become difficult to position. Preferably the angle of the cam shaft groove is between about 5°–45° to the axis of the drive ring 250, and most preferably, the angle is in the range of about 7° to about 14°.

Figure 14:
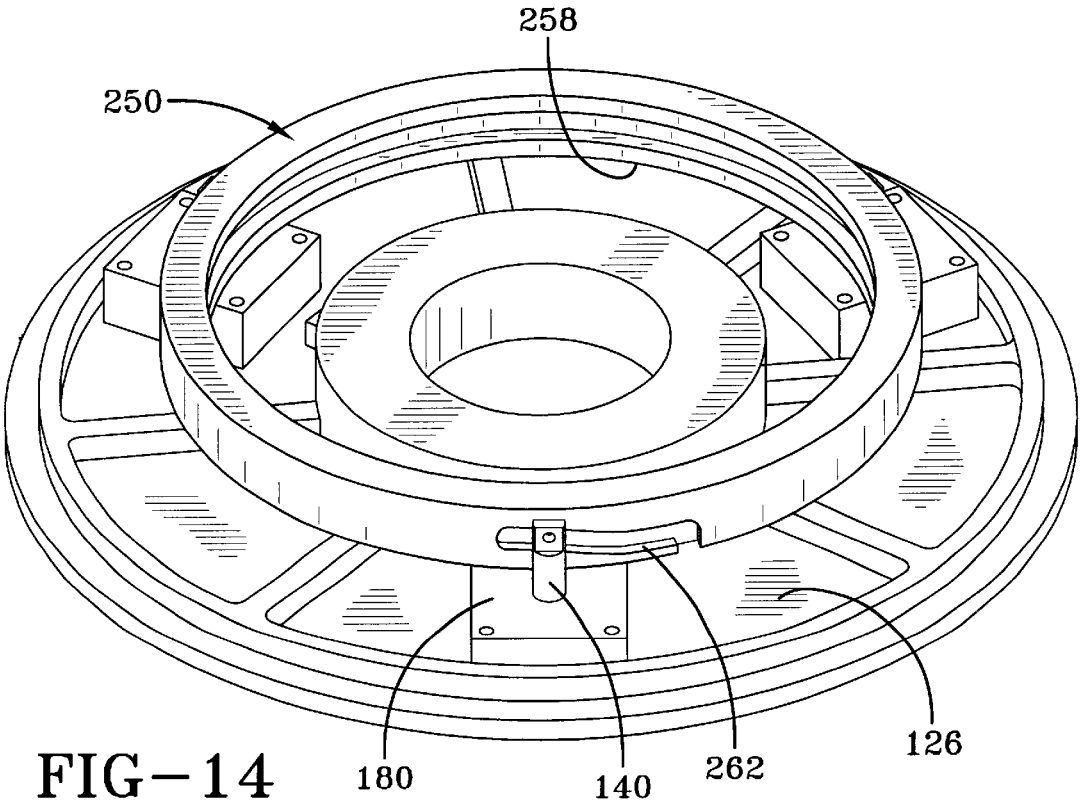
FIG. 14 is a perspective view of an assembly comprising the nozzle base plate with support blocks attached thereto and a drive ring assembled thereon.

FIG. 14 is a perspective view of drive ring 250 assembled onto support blocks 180. The support blocks 180 extend underneath drive ring 250. Support blocks 180 are assembled to nozzle base plate 126. Drive pins 140 are assembled into support blocks as shown in FIG. 11, drive pins extending down through nozzle base plate 126. Cam followers 200, not visible in FIG. 14 but constructed as shown in FIG. 12, are assembled into cam track 262. As can be seen in FIG. 14, support blocks 180 extend under bottom surface 258 of drive ring 250.

Figure 15:
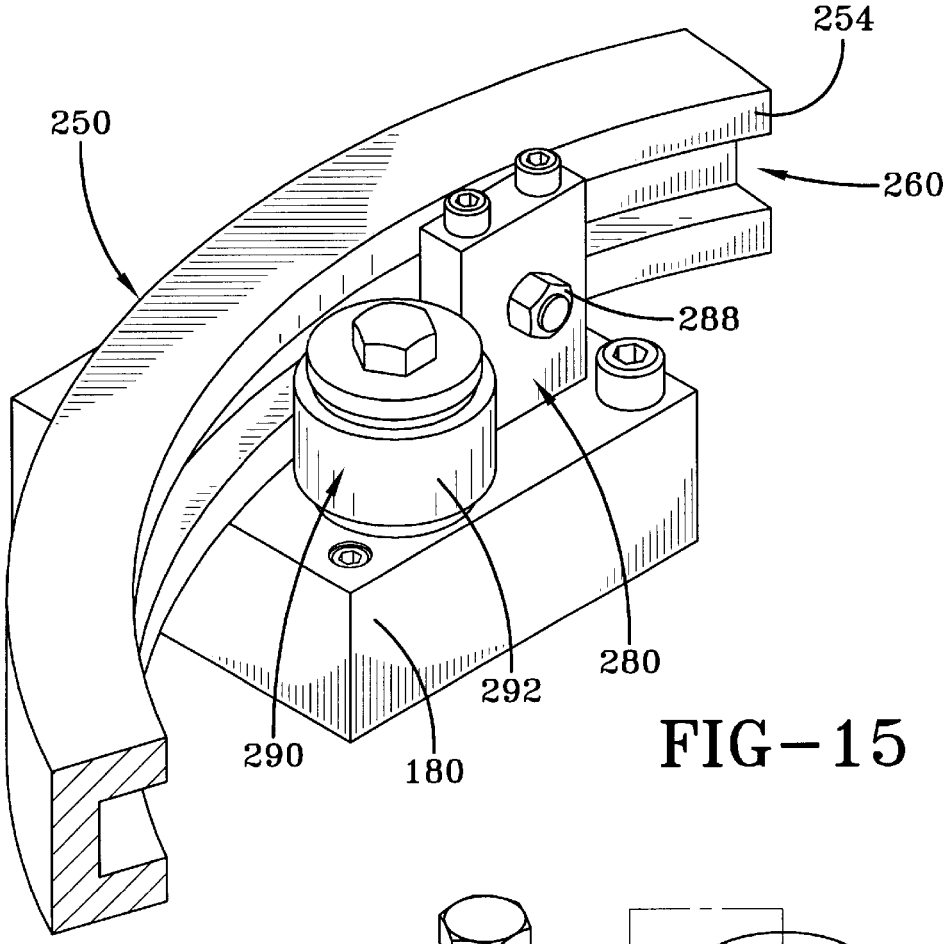
FIG. 15 is a perspective view of the inner circumferential surface of the drive ring assembled to a support block with a radial bearing assembly and an axial bearing assembly installed in the support block.

Referring now to FIG. 15, which is a perspective view of one of support blocks 180 extending under drive ring 250. This view shows inner circumferential surface 254 and inner circumferential groove 260 of drive ring 250. Assembled to bearing block 180 is an axial bearing assembly 280 and a radial bearing assembly 290.

Figure 16:
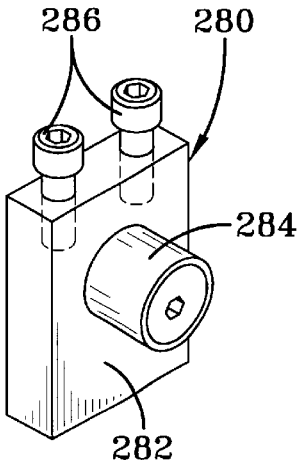
FIG. 16 is a perspective view of an axial bearing assembly.
Figure 19:
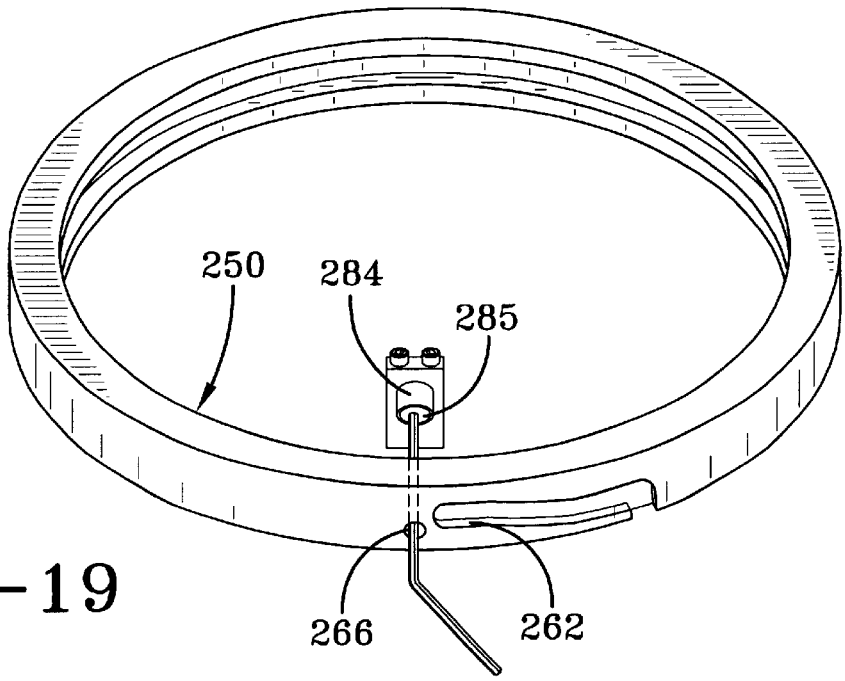
FIG. 19 is an overhead view of the axial bearing adjustment to drive ring.

A perspective view of axial bearing assembly 280 is provided in FIG. 16. Axial bearing assembly 280 comprises a support structure 282 for axial bearing 284 and attachment means 286 to secure the support structure 282 to support block 180. A shaft (not shown) extends through support structure 282. At one end of the shaft is a bushing 285 which is preferably eccentric. As shown in the preferred embodiment, attachment means 286 is substantially a pair of threaded members that are captured in mating holes in support block 180. Any other well-known means of securing the support structure 282 to support block 180 may be utilized. Referring back to FIG. 15, axial bearing 284 is installed onto support block 282 by a means for securing 288. As shown in FIG. 15, means for securing axial bearing 284 to support block 282 is a nut fastened to a threaded end of the shaft extending through support block 282. Bushing 285 is free to rotate about the opposite end of this shaft. Again, any other arrangement for securing axial bearing 284 in position opposite inner circumferential groove 260 may be used. As depicted in FIG. 15, axial bearing 284 (hidden from view) is assembled into inner circumferential groove 260. Axial bearing 284 resists axial movement of drive ring 250 as it rotates. In addition to resisting axial movement of drive ring 250, the axial bearing 284 also allows for small adjustments of the axial location of the drive ring 250. This adjustment is necessary to account for the variation in the length of the drive pins 140. The adjustment is possible due to an eccentric bushing 285 on the shaft of axial bearing 284. Following the assembly of axial bearings 284 into drive ring 250, drive ring 250 is rotated such that drive pin cam follower 200 is at the end of travel in cam track 262 next to aperture 266. This aligns axial bearing 284 with aperture 266 adjacent to cam track 262. In this position, as shown in FIG. 19, a tool such as a hexagon (Allen) wrench can be inserted through aperture 266 into a feature matching the wrench head, here a hex hole to match the wrench hex head located on axial bearing 284. Axial bearing 284 is rotated clockwise or counterclockwise as necessary to adjust the axial position of drive ring 250 with respect to bushing 285. Once the position is correct, axial bearing 284 is secured by tightening nut on the opposite end of shaft. The preferred adjustment of drive ring 250 is such that the face of diffuser ring 130 is flush with the face of nozzle base plate 125 when diffuser ring is in the fully retracted position.

Figure 17:
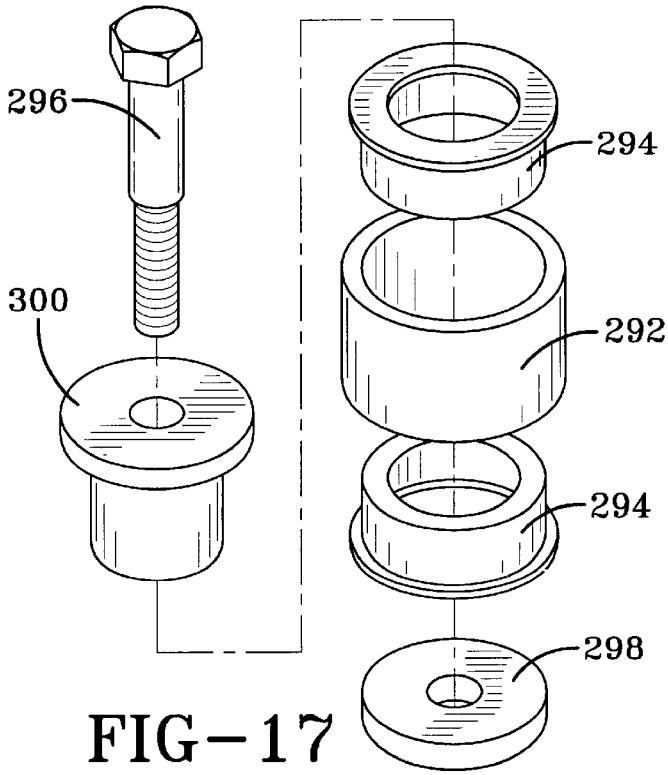
FIG. 17 is an exploded view of a radial bearing assembly.
Figure 20:
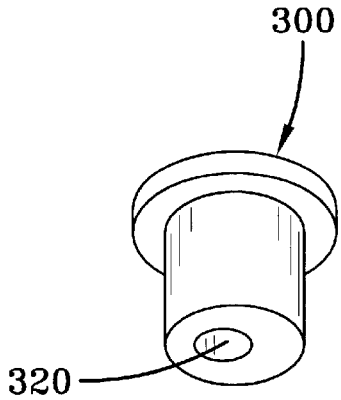
FIG. 20 is a perspective view of an eccentrically drilled mounting hole 320 in a flanged race 300 of a radial bearing.

FIG. 15 also shows radial bearing assembly 290 installed onto support block 180. FIG. 17 provides an exploded view of radial bearing assembly 290. Radial bearing assembly 290 comprises a roller 292 and at least one bushing 294 installed in the roller 292, and preferably two flanged bushings 294, one on either side of roller 292. A flanged race 300 is assembled into the at least one bushing 294. In a preferred embodiment, the pair of flanged bushings 294 comprise two TEFLON®-flanged bushings, one installed into either end of roller 292. A partially threaded shaft 296 extends through race 300 to secure the assembly to support block 180. A washer 298 may be added between roller 292 and support block 180. One of the radial bearing assemblies 290 employs an eccentrically drilled mounting hole 320 in the flanged race 300 as shown in FIG. 20. The eccentric mounting hole allows for adjustment of the radial bearing 290. This adjustment is necessary to compensate for variations in the inside diameter of drive ring 250. The preferred adjustment is to have all radial bearings just contacting the inner surface of drive ring 250. The radial bearing assembly 290 resists radial movement of drive ring 250 as it rotates. Any other suitable radial bearing assembly may be utilized that can resist radial movement of the drive ring 250 as it rotates.

Figure 4:
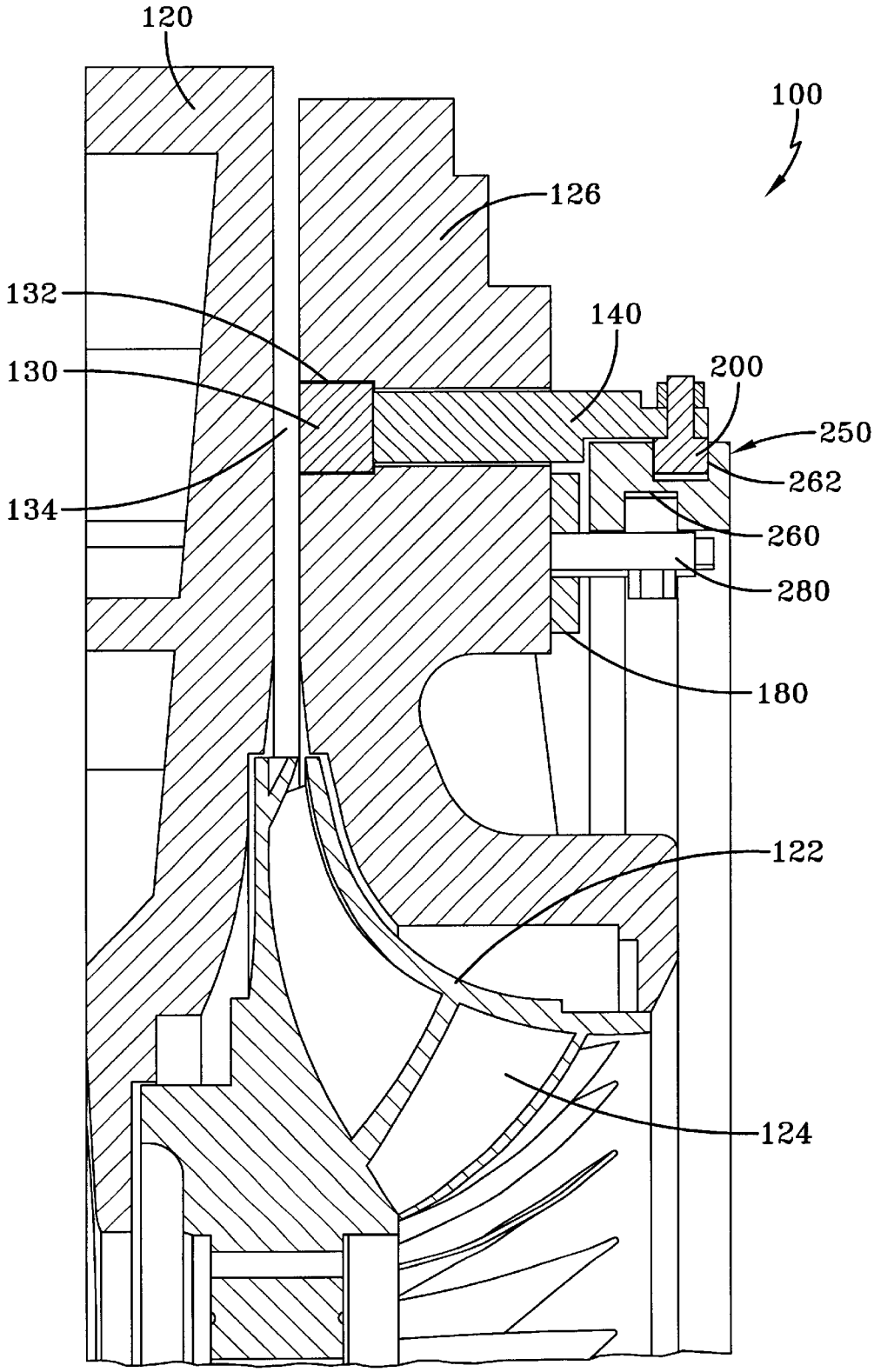
FIG. 4 is a cross section view of the variable geometry diffuser of the present invention in a centrifugal compressor in which the diffuser ring of the present invention is in the retracted or open position.
Figure 18:
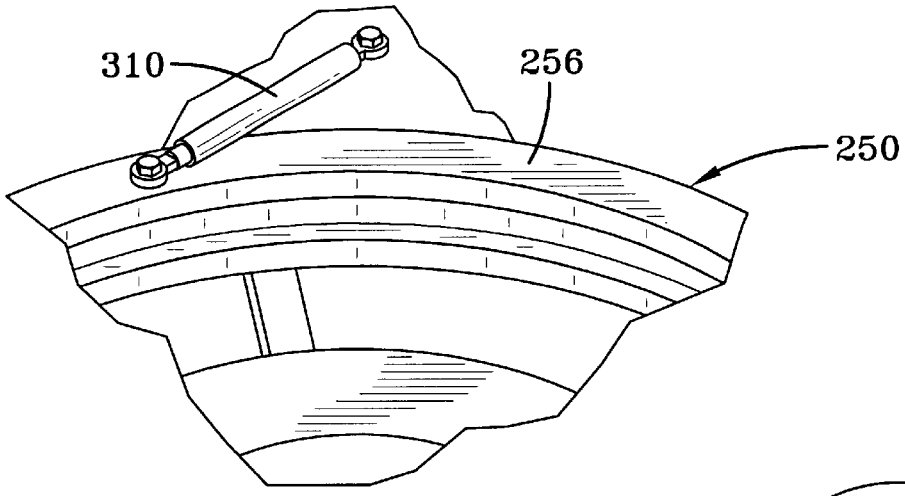
FIG. 18 is a perspective view of an actuator assembled to a drive ring.

Operation of the mechanism can now be described by reference to FIGS. 2, 3 and 4 as well as to FIG. 18. FIG. 18 is a perspective view of an actuating means 310 attached to top surface 256 of drive ring 250. As shown in FIG. 18, actuating means 310 is a mechanical actuator that moves only in an axial direction and is attached to a motor that causes it to move. Although a mechanical actuator is used, any other well-know means for rotating the drive ring 250 may be used, including hydraulic actuators, pneumatic actuators, a screw mechanism attached to the drive ring 250 or other systems that can cause rotation of the ring 250. The direction and length of its stroke is limited. The axial motion of the actuator causes the drive ring to rotate. The motor is activated in response to a control means such as described in provisional application identified as Attorney Docket 20712-0059 entitled SYSTEM AND METHOD FOR DETECTING ROTATING STALL IN CENTRIFUGAL COMPRESSORS. However, any other control means for an actuator may be used. As the compressor operates in its normal mode with the diffuser ring in its retracted position, as shown in FIG. 4, if the onset of stall or incipient surge is detected by a sensor, a signal is sent to the controller which activates the motor in a direction to cause the diffuser gap 134 to close. The motor moves the actuating means 310 which causes drive ring 250 to rotate. Drive ring 250 is restricted to rotational movement in the plane in which it resides over support blocks 180. As drive ring 250 rotates, each of cam followers 200 moves from a first position in cam tracks 262 where the cam track grooves are proximate the top surface 256 of drive ring 250 along the tracks toward bottom surface 258 of drive ring 250. As the drive ring 250 and cam tracks 262 rotate, cam followers 200 are forced downward along the tracks 262. As the followers move downward, drive pins 140 move into support block 180. Since diffuser ring 130 is attached to the opposite end of drive pin 140 on the opposite side of nozzle base plate 126, the movement of drive pin 140 into support block 180 moves the opposite side of drive pin 140 away from nozzle base plate, causing diffuser ring 130 to move into diffuser gap 134. If cam followers 200 move in cam tracks 262 completely from a position proximate top surface 256 to a position proximate bottom surface 258, then diffuser gap 134 is in a substantially fully choked or closed position. The horizontal groove portions 264 of cam tracks 262 allow for overtravel of the actuating means 310 and cam followers 200, so that some additional movement of these elements can be accommodated without further movement of the diffuser ring 130 which could cause damage to any one of or all of the compressor 100, the drive ring 250, the actuating means 310 and the actuating means motor.

Depending upon the control system, the actuating means 310 may stop drive ring 250 rotation at any position intermediate between the fully extended position and fully retracted position of actuating means 310. It can do this in response to a signal from the control means. This in turn results in the diffuser ring 130 being stopped in any position, such as an intermediate position shown in FIG. 2 between fully retracted, as shown in FIG. 4 to fully extended as shown in FIG. 3. It will remain in this position until a signal from control means causes additional movement of the drive ring 250 which causes a repositioning of diffuser ring 130.

In a preferred embodiment, once a signal is sent to the control means indicating the detection of the onset of surge or incipient stall, a command (or series of commands) is activated which causes the drive ring 250 to rotate as described above, thereby causing diffuser ring 130 to move to an extended position (substantially choking the flow of fluid through diffuser gap 134) an amount necessary to eliminate the surge or incipient stall or prevent the formation of a surge or stall condition. In one embodiment, a timing function may be activated in the controller which maintains the diffuser ring 130 at the required position. At the end of a preselected time period, the drive ring 250 is rotated in the opposite direction, thereby causing diffuser ring 130 to move to a retracted position until the onset of surge or incipient stall is again detected. Repeating the above process in response to a sensor signal causes a command (or series of commands) to be again activated which causes the drive ring 250 to rotate, thereby causing diffuser ring 130 to move or extend, again choking the flow of fluid through diffuser gap 134 the amount necessary to eliminate the surge or incipient stall condition. This process repeats as long as a surge or incipient stall condition is detected. If no surge or incipient stall condition is detected when diffuser ring 130 is retracting, the diffuser ring 130 will continue to retract to the fully retracted or open position, thereby allowing full flow of refrigerant through diffuser gap 134. It will remain in this position until the control means activates the command or series of commands in response to a signal indicative of the onset of surge or incipient stall.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the appended claims.

What is claimed is:

1. A diffuser system for a variable capacity centrifugal compressor for compressing a fluid, the compressor having a housing and an impeller, the impeller being rotatably mounted in the housing, the system comprising:

a nozzle base plate connected to the housing adjacent the impeller, the nozzle base plate having an elongated surface that cooperates with an opposed interior surface on the housing to define a diffuser gap, the elongated surface of the nozzle base plate having a groove adjacent the diffuser gap;

a plurality of support blocks mounted to a back side of the nozzle base plate opposite the diffuser gap;

a drive ring rotatably mounted to the support blocks and movable between a first position and a second position, the drive ring including a plurality of cam tracks positioned on a circumference of the drive ring, at least two of the plurality of cam tracks aligned with at least two of the plurality of support blocks;

an actuating means attached to the drive ring and movable between a first axial position and a second axial position to move the drive ring between the first position and the second position;

a plurality of drive pins, each drive pin extending through a corresponding support block and the nozzle base plate, each drive pin having a first end and a second end opposite the first end, the first end of the drive pin including a cam follower mounted into a cam track on the drive ring and the second end of the drive pin extending through the nozzle base plate into the groove on the surface of the nozzle base plate;

a diffuser ring mounted on the second end of each of the plurality of drive pins, the drive pins extending into the groove on the nozzle base plate surface;

wherein the rotational movement of the drive ring between a first position and a second position moves the cam followers in the cam track which axially moves the drive pins, the axial movement of the drive pins moves the diffuser ring between a retracted position in which the diffuser ring resides in the groove on the nozzle base plate and an extended position in which the diffuser ring substantially closes the diffuser gap to reduce fluid flow through the diffuser gap.

2. The system of claim 1 wherein each of the plurality of support blocks is aligned with one of the plurality of cam tracks.

3. The system of claim 1 wherein three support blocks are mounted to a back side of the nozzle base plate.

4. The system of claim 3 wherein the drive ring includes three cam tracks, each cam track being aligned with a support block.

5. The system of claim 3 wherein the drive ring includes three cam tracks, each cam track being aligned with a support block.

6. The system of claim 1 wherein the nozzle base plate groove has a depth sufficient to receive the diffuser ring when the diffuser ring is in the retracted position so that no portion of the diffuser ring extends outwardly into the diffuser gap.

7. The system of claim 1 wherein the plurality of support blocks are mounted to the back side of the nozzle base plate with fastening means.

8. The system of claim 7 wherein the fastening means includes threaded fasteners extending into threaded apertures on each of the support blocks and corresponding threaded apertures on the nozzle base plate.

9. The system of claim 7 wherein the fastening means includes threaded fasteners extending into threaded apertures on each of the support blocks and corresponding threaded apertures on the nozzle base plate.

10. The system of claim 1 wherein the plurality of support blocks are integrally manufactured with the nozzle base plate.

11. The system of claim 10 wherein the plurality of support blocks are included as cast elements in a nozzle base plate casting.

12. The system of claim 10 wherein the plurality of support blocks are included as cast elements in a nozzle base plate casting.

13. The system of claim 1 wherein the drive ring includes a top surface, a bottom surface, an inner circumferential surface extending axially between the top surface and the bottom surface, an outer circumferential surface extending axially between the top surface and the bottom surface, and a circumferential groove extending along at least a portion of the inner circumferential surface, the circumferential groove having a preselected width in the axial direction and a preselected length.

14. The system of claim 13 wherein each cam track is fabricated as a groove in the outer circumferential surface, the groove having a preselected width sufficient to receive one of the cam followers and a preselected depth, the groove extending at a preselected angle to an axis of the drive ring.

15. The system of claim 14 wherein the preselected angle is between about 5°–45°.

16. The system of claim 14 wherein the preselected angle is about 7–14°.

17. The system of claim 14 wherein the groove further includes a portion at a first end in a plane parallel to the top surface and a portion at an opposite end in a plane parallel to the bottom surface, these portions accommodating overtravel of one of the cam followers.

18. The system of claim 13 further including a plurality of axial bearing assemblies, each axial bearing assembly comprising a support structure, a first means for securing the axial bearing assembly to the support structure, an axial bearing on a shaft extending through the support structure, the axial bearing being rotatable about the shaft, and a second means for securing the axial bearing to the support structure, wherein each axial bearing is positioned in the circumferential groove to resist axial movement of the drive ring as it rotates when the bearing is assembled to the support structure and the support structure is secured to prevent movement of the bearing out of the groove.

19. The system of claim 18 wherein the first means of securing the axial bearing assembly to the support structure includes a pair of threaded fasteners extending through apertures in the support structure and into mating threaded apertures in the support block, whereby the support structure is secured to the support block by the fasteners.

20. The system of claim 18 wherein the second means of securing the axial bearing to the support structure includes a threaded nut attached to a threaded end of the shaft, the threaded end of the shaft extending through the support structure on a side of the support structure opposite the axial bearing.

21. The system of claim 13 further including a radial bearing assembly wherein the radial bearing assembly includes a roller having an inner aperture, at least one flanged bushing installed in the inner aperture of the roller and a shaft for fixedly securing the radial bearing in contact with the inner circumference of the drive ring to counteract radial movement of the drive ring.

22. The system of claim 21 wherein the radial bearing assembly includes a pair of flanged bushings.

23. The system of claim 21 wherein the at least one flanged bushing includes TEFLON® flanges.

24. The system of claim 21 wherein the radial bearing shaft secures the radial bearing to a support block.

25. The system of claim 1 wherein the actuating means includes a motor attached to a mechanical actuator having a cylinder linearly movable between a first contracted position and a second extended position, whereby activation of the motor causes linear movement of the mechanical actuator which rotates the drive ring.

26. The system of claim 1 wherein the actuating means is a hydraulic actuator having a cylinder linearly movable between a first contracted position and a second extended position, whereby the linear movement of the hydraulic actuator in response to pressure from an applied fluid rotates the drive ring.

27. The system of claim 1 wherein the actuating means includes a motor attached to a mechanical actuator having a threaded member, whereby the motor, upon activation, rotates the threaded member which moves the actuator between a first contracted position and a second extended position, whereby the movement of the actuator rotates the drive ring.

28. The system of claim 1 further including a sensor positioned within the compressor to sense the presence and absence of a stall condition and to send a signal, a controller in communication with the sensor and the actuating means, the controller sending a signal to the actuating means to position the drive ring and connected diffuser ring in response to the signal received from the sensor.

29. The system of claim 28 wherein the sensor is positioned adjacent the impeller.

30. The system of claim 1 wherein each of the plurality of support blocks is aligned with one of the plurality of cam tracks.

31. The system of claim 1 wherein three support blocks are mounted to a back side of the nozzle base plate.

32. The system of claim 1 wherein the nozzle base plate further includes a groove on its elongated surface having a depth sufficient to receive the diffuser ring when the diffuser ring is in the retracted position so that no portion of the diffuser ring extends outwardly into the diffuser gap.

33. The system of claim 1 wherein the plurality of support blocks are mounted to the back side of the nozzle base plate with fastening means.

34. The system of claim 1 wherein the plurality of support blocks are integrally manufactured with the nozzle base plate.

35. The system of claim 1 wherein the drive ring includes a top surface, a bottom surface, an inner circumferential surface extending axially between the top surface and the bottom surface, an outer circumferential surface extending axially between the top surface and the bottom surface, and a circumferential groove extending along at least a portion of the inner circumferential surface, the circumferential groove having a preselected width in the axial direction and a preselected length.

36. A system for a variable capacity centrifugal compressor for compressing a fluid, the compressor having a housing and an impeller, the impeller being rotatably mounted in the housing, the system comprising:

a nozzle base plate fixed to the housing adjacent the impeller, the nozzle base plate having an elongated surface that cooperates with an opposed interior surface on the housing to define a diffuser gap, the elongated surface of the nozzle base plate having a groove adjacent the diffuser gap;

three support blocks positioned concentrically on a back side of the nozzle base plate opposite the diffuser gap about 120° apart;

a drive ring mounted substantially out of contact with the support blocks rotationally selectably movable with respect to the support blocks and the nozzle base plate between a first position and a second position, the drive ring a top surface, a bottom surface, an inner circumference extending between the top surface and the bottom surface, an outer circumference extending between the top surface and the bottom surface, the inner circumference including an inner circumferential groove, the drive ring including three cam tracks positioned on the outer circumference of the drive ring about 120° apart, each of the cam tracks aligned with each of the support blocks;

an actuator having a motor movable between a first axial position and a second axial position attached to the drive ring to rotate the drive ring from the first position to the second position;

three drive pins, one drive pin extending through each of the support blocks and the nozzle base plate, a first end of each drive pin including a cam follower mounted into one of the cam tracks on drive ring and the second end of each drive pin extending through the nozzle base plate into the groove on the surface of the nozzle base plate;

three axial bearing assemblies, one axial bearing assembly mounted to each of the support blocks and each axial bearing assembly positioned within the inner circumferential groove of the drive ring to resist axial movement of the drive ring as it rotates;

three radial bearing assemblies, one radial bearing assembly mounted to each of the support blocks and each radial bearing assembly positioned in contact with an inner circumferential surface to resist radial movement of the drive ring as it rotates;

a diffuser ring mounted on the second end of the drive pins extending into the groove on the nozzle base plate;

a sensor positioned within the compressor to provide signals indicative of a fluid condition in the compressor;

a controller in communication with the sensor and the actuator, the controller sending a signal to the actuator to position the drive ring and connected diffuser ring in response to signals received from the sensor;

wherein the motion of the actuator in response to the signal from the controller causes the rotational movement of the drive ring between a first position and a second position, causing axial movement of the drive pins by movement of the cam followers in the cam tracks, which causes movement of diffuser ring between a first position corresponding to a first position of the drive ring and a second position corresponding to a second position of the drive ring to control fluid flow through the diffuser gap and prevent compressor stall.

37. A centrifugal compressor, comprising:

a housing;

a fluid inlet;

an impeller assembly rotatably mounted on a shaft in the housing for compressing fluid introduced through the inlet;

a fluid outlet to discharge compressed fluid from the impeller;

a nozzle base plate connected to the housing adjacent the impeller, the nozzle base plate having an elongated surface that cooperates with an opposed interior surface on the housing to define a diffuser gap;

a plurality of support blocks positioned on a back side of the nozzle base plate opposite the diffuser gap;

a drive ring rotatably mounted to the support blocks and movable between a first position and a second position, the drive ring including a plurality of cam tracks positioned on a circumference of the drive ring, at least two of the plurality of cam tracks aligned with at least two of the plurality of support blocks;

an actuating means movable in its axial direction attached to the drive ring and movable between a first axial position and a second axial position to move the drive ring between the first position and the second position;

a plurality of drive pins, each drive pin extending through a corresponding support block and the nozzle base plate, each drive pin having a first end and a second end opposite the first end, the first end of the drive pin including a cam follower mounted into one of the plurality of cam tracks on the drive ring and the second end of the drive pin extending through the nozzle base plate and protruding from the elongated surface;

a diffuser ring mounted on the second end of each of the plurality of drive pins protruding from the nozzle base plate surface;

wherein the rotational movement of the drive ring between a first position and a second position moves the cam followers in the cam track which axially moves the drive pins, the axial movement of the drive pins moves the diffuser ring between a retracted position in which the diffuser ring is distal from the opposed interior surface of the housing to increase fluid flow through the diffuser gap and an extended position in which the diffuser ring is proximal to the opposed interior surface of the housing to substantially close the diffuser gap and reduce fluid flow through the diffuser gap.

* * * * *

UNITED STATES PATENT AND TRADEMARK OFFICE

CERTIFICATE OF CORRECTION

PATENT NO. : 6,872,050 B2
DATED : March 29, 2005
INVENTOR(S) : Nenstiel

It is certified that error appears in the above-identified patent and that said Letters Patent is hereby corrected as shown below:

Column 10,
Line 56, “thereof Therefore” should be -- thereof. Therefore --.

Column 12,
Line 63, “TEFLON ®” should be -- tetrafluoroethylene --.

Signed and Sealed this

Twenty-ninth Day of November, 2005

JON W. DUDAS
*Director of the United States Patent and Trademark Office*